US005507071A

United States Patent [19]

Berfield

[11] Patent Number: 5,507,071

[45] Date of Patent: Apr. 16, 1996

[54] HANDLE FOR VACUUM MOTOR HOUSING

[75] Inventor: Robert C. Berfield, Jersey Shore, Pa.

[73] Assignee: Shop Vac Corporation, Williamsport, Pa.

[21] Appl. No.: 247,359

[22] Filed: May 23, 1994

[51] Int. Cl.[6] ..... A47B 95/02

[52] U.S. Cl. ..... 16/110 R

[58] Field of Search ..... 16/110 R, 111 R, 16/114 R, 124, DIG. 15

[56] References Cited

U.S. PATENT DOCUMENTS

| | | | |
|---|---|---|---|
| 1,720,948 | 7/1929 | Duggan | 16/DIG. 15 |
| 2,959,342 | 11/1960 | Silverstein | 16/110 R |
| 4,632,888 | 12/1986 | Kump et al. | 16/DIG. 15 |
| 5,317,795 | 6/1994 | Bolton et al. | 16/124 |

*Primary Examiner*—Maurina T. Rachuba
*Assistant Examiner*—Chuck Y. Mah
*Attorney, Agent, or Firm*—Marshall, O'Toole, Gerstein, Murray & Borun

[57] ABSTRACT

A U-shaped handle is attachable to a motor housing by a first projection on the end of the handle that engages a tab on the inside of the housing and by a second projection on the inside of the handle that engages a vent on the side of the housing. The projections are located on opposite sides of a fulcrum point such that applying a force to disengage either of the projections reinforces the engagement of the other projection, making the handle difficult to remove from the motor housing.

16 Claims, 4 Drawing Sheets

FIG. 2
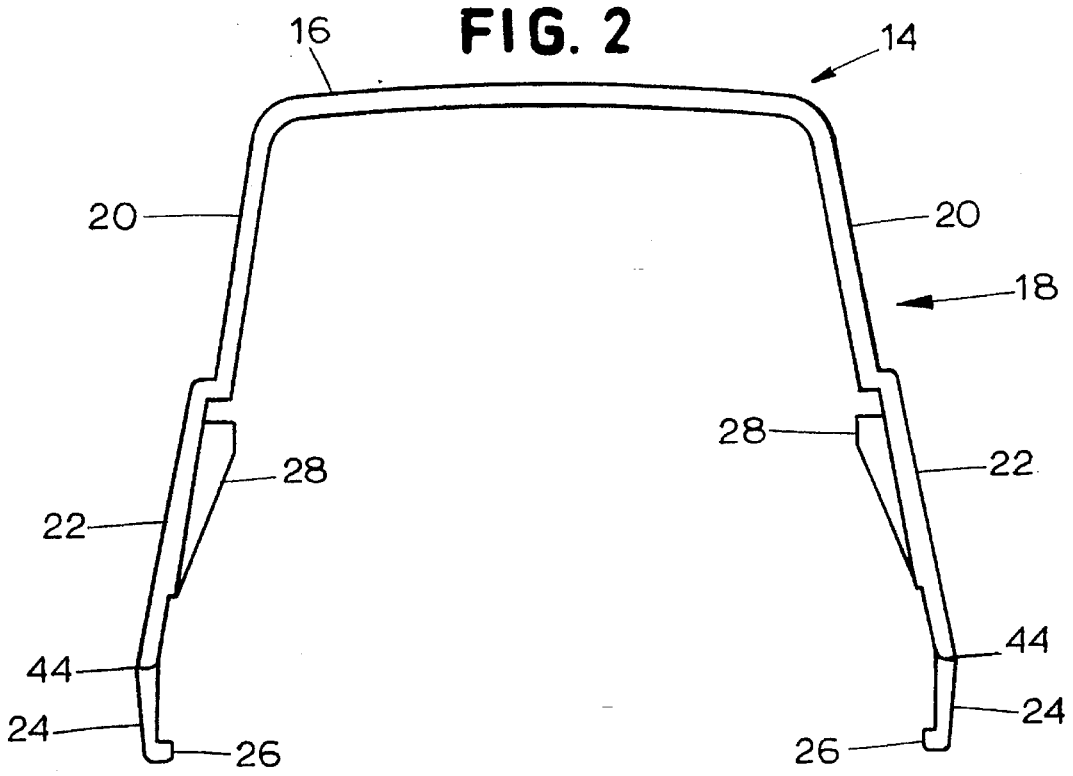
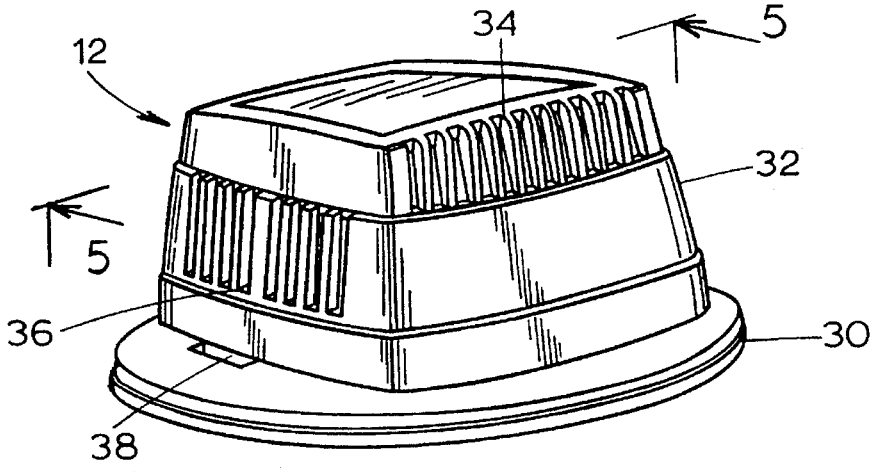
FIG. 4

HANDLE FOR VACUUM MOTOR HOUSING

TECHNICAL FIELD

The present invention relates generally to vacuum apparatus, and more particularly to a handle attachable to a vacuum motor housing.

BACKGROUND ART

Typically, wet/dry vacuums are large units that must be mounted on wheels to enable a user to move the machine. However, the introduction of a smaller, portable wet/dry vacuum facilitates the need for a handle attached to the unit such that a user can easily lift and carry the unit by the handle.

Packaging considerations dictate that the handle be disassembled from the vacuum before sale. Thus, the user must attach the handle after purchase but before operating the vacuum. Therefore, there is a need for a handle that is easily attachable to the vacuum but is securely fastened thereon after assembly.

SUMMARY OF THE INVENTION

A handle attachable to a motor housing comprises a main section and a leg having a fulcrum point extending from the main section including a first projection on one end of the leg and a second projection on the inside of the leg, wherein the projections are located on opposite sides of the fulcrum point. The motor housing comprises first receiving means for engaging the first projection and second receiving means for engaging the second projection, wherein applying a force to disengage either of the projections from the receiving means reinforces the engagement of the other projection with the other receiving means.

According to a preferred embodiment of the present invention, the first and second projections are located on opposite sides of the leg. The first receiving means comprises a slot on the base of the motor housing and a tab located below the slot on the inside of the motor housing. The first projection comprises a horizontal lip on one end of the leg that passes through the slot and engages the tab on the inside of the motor housing such that the fulcrum point contacts a bearing surface on the inside of the slot. The second receiving means comprises a vent opening on the side of the motor housing and the second projection comprises a vertical fin extending inwardly from the middle of the leg. The fin engages walls defining the vent opening on the side of the motor housing.

According to yet another aspect of the present invention, a handle attachable to a motor housing comprises a main section and a pair of legs extending from the main section, each leg including a top section joined to the main section, a middle section and a bottom section. A horizontal lip extends from the bottom section of each leg and a vertical fin extends inwardly from the middle section of each leg.

According to an alternative embodiment of the present invention, the motor housing is connected to a blower housing and a rib on the inside of the blower housing engages the bottom section of the leg and the tab on the inside of the motor housing.

BRIEF DESCRIPTION OF THE DRAWINGS

FIG. 2 is a front elevational view of the handle;

FIG. 4 is a perspective view of the motor housing before attachment of the handle;

DESCRIPTION OF THE PREFERRED EMBODIMENT

Figure 1:
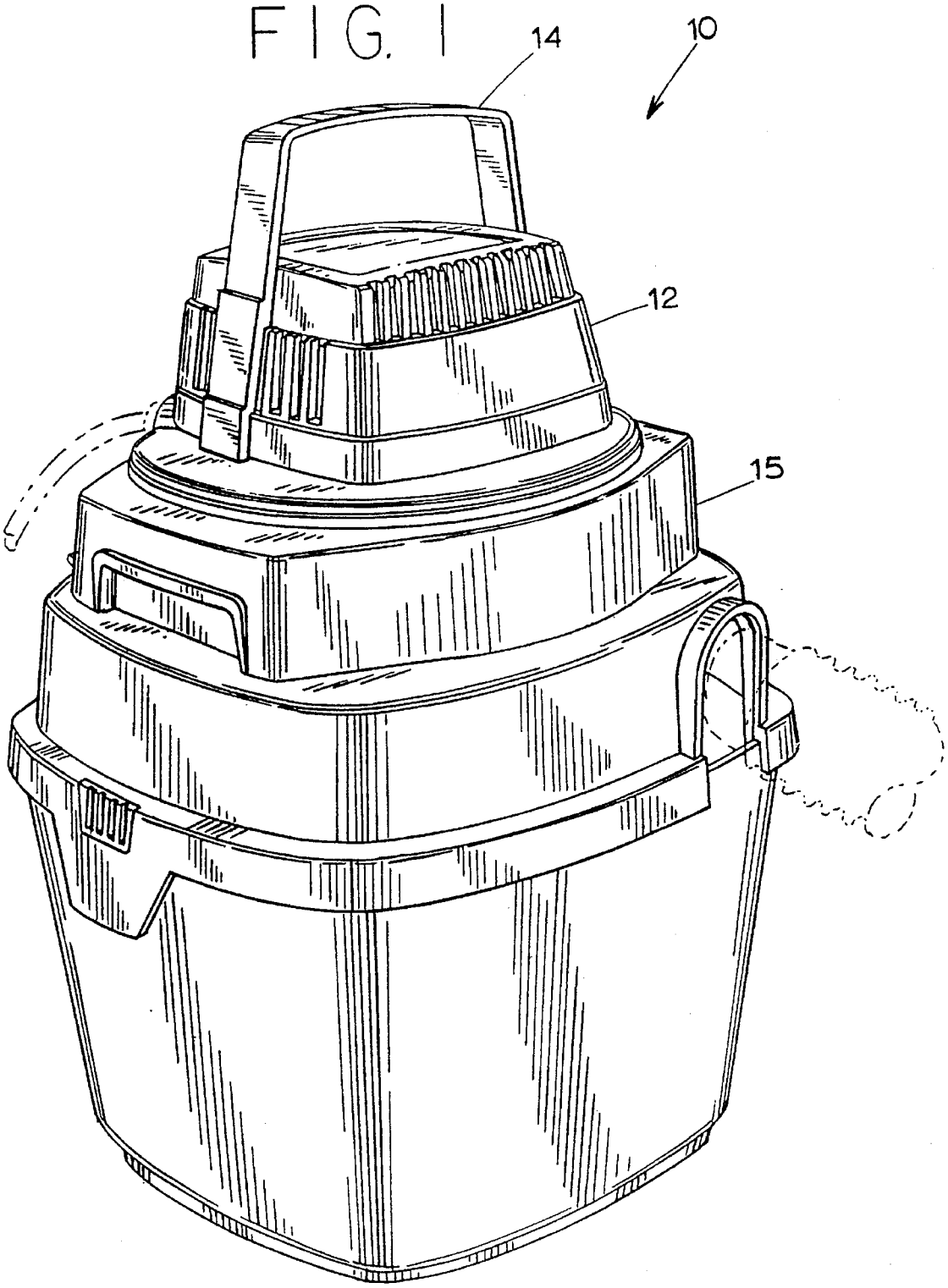
FIG. 1 is a perspective view of a wet/dry vacuum incorporating the handle of the present invention.

The wet/dry vacuum 10 shown in FIG. 1 has a motor housing 12, a handle 14 and a blower housing 15. The handle 14 is designed to be attached by the user to the motor housing 12 after the vacuum 10 is purchased. The handle 14 is easy to attach to the motor housing 12 but is difficult to remove once it is attached.

Figure 3:
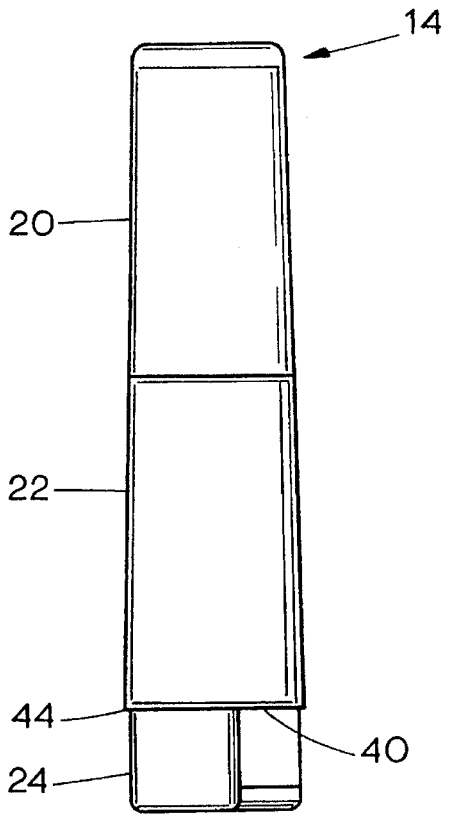
FIG. 3 is a side view of the handle.

Referring to FIG. 2, the handle 14 has a general inverted U-shape, with a main section 16 and a pair of legs 18 extending from the main section 16. Each leg 18 has a top section 20, a middle section 22 and a bottom section 24. The middle section 22 of each leg 18 extends slightly outward from the top section 20 and the bottom section 24 angles inwardly from the middle section 22. As seen in FIG. 3, the bottom section 24 of each leg 18 has a width narrower than the width of the adjoining middle section 22.

A horizontal lip 26 extends across the width of the bottom section 24. Also, a vertical fin 28 extends inwardly from the middle section 22 of each handle leg 18. Thus, the fins 28 extend toward each other on the inside of the handle 14. The lip 26 and fin 28 are located on opposite sides of the leg 18.

Figure 5:
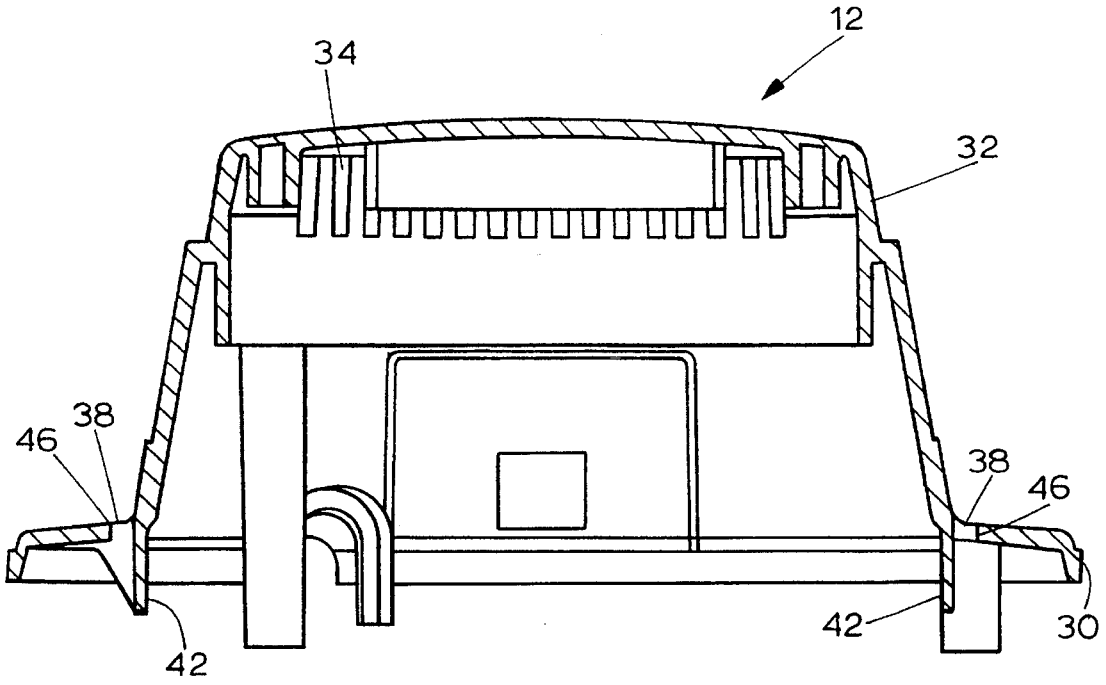
FIG. 5 is a cross-sectional view of the motor housing taken along line 5—5 of FIG. 4.
Figure 6:
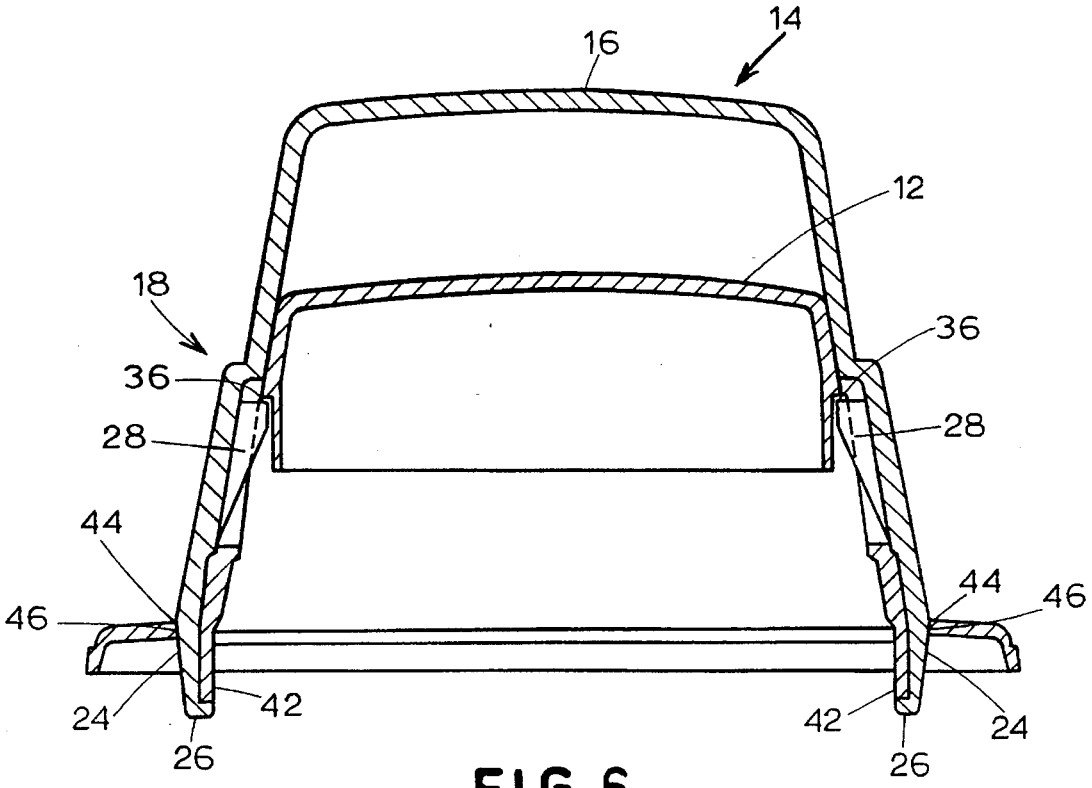
FIG. 6 is a cross-sectional view of the handle attached to the motor housing.

Referring to FIGS. 4 and 5, the motor housing 12 has a circular base 30 and a generally square-shaped body 32. A plurality of vertical vents, indicated generally at 34, are located along the sides of the body 32 and allow for cooling of the motor. A further plurality of vents 36 are located on opposite sides of the motor housing body 32. The fins 28 on the inside of the handle legs 18 engage walls defining the vents 36 when the handle 14 is attached to the motor housing 12, as shown in FIG. 6.

According to a preferred embodiment of the present invention, the base 30 of the motor housing 12 has a slot 38 beneath and slightly offset from each of the side vents 36. The slots 38 are slightly longer than the width of the bottom section 24 of the handle leg 18, such that the bottom section 24 of a leg 18 can be accommodated in a respective slot 38.

The handle 14 may be easily snapped onto the motor housing 12 by aligning the ends of the bottom sections 24 of the handle legs 18 with the slots 38 on the motor housing base 30. This also aligns the vertical fins 28 with the openings of the side vents 36. The user then pushes down on the main section 16 of the handle 14, which causes the fin 28 to slide into the opening of the side vent 36 and the end of the bottom section 24 to pass through the slot 38 until a shoulder 40 of the middle section 22 rests on the base 30 of the motor housing 12. At this point, the lip 26 hooks onto a tab 42 on the inside of the motor housing 12 so that the handle 14 is securely maintained on the motor housing 12.

The handle 14 is difficult to remove once it is attached to the motor housing 12. As shown in FIGS. 2 and 6, the lip 26 and tab 42 are located on the opposite side of a fulcrum point 44 than the fin 28 and vent 36. The fulcrum point 44 is located where the bottom section 24 of the leg 18 joins the middle section 22 of the leg 18. When the handle 14 is attached to the motor housing 12, the fulcrum point 44 contacts a bearing surface 46 on the inside of the slot 38 on the base 30 of the motor housing 12. Thus, the leg 18 will pivot slightly about the fulcrum point 44.

To disengage the fin 28 from the vent 36, a user must apply a force outwardly on the top section 20 or middle section 22 of the handle leg 18. While this force causes the fin 28 to separate from the vent 36, it also forces the fulcrum point 44 against the bearing surface 46 inside of the slot 38, causing the leg 18 to pivot and force the lip 26 more tightly against the tab 42. Likewise, applying a force outwardly to the lip 26 to disengage it from the tab 42 causes the leg 18 to pivot about the fulcrum point 44 and force the fin 28 more tightly into the vent 36. Further, once the handle 14 is attached to the motor housing 12, the user can only access the lip 26 to disengage it from the tab 42 by removing the motor housing 12 from the vacuum 10. Still further, the handle 14 is manufactured from a semi-rigid plastic material such that it is difficult to bend out of its attached position.

Figure 7:
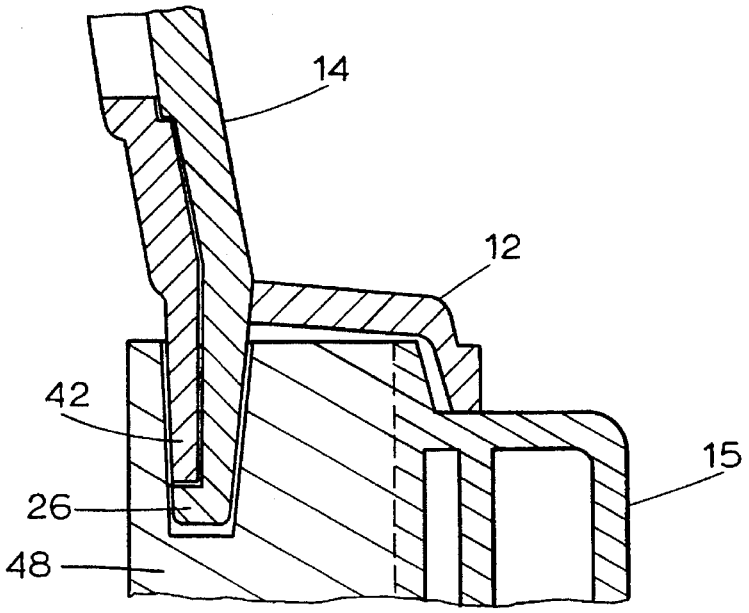
FIG. 7 is a cross-sectional view of the handle attached to the motor housing connected to the blower housing of an alternative embodiment of the invention.

According to an alternative embodiment of the present invention, ribs 48 may be molded into the inside of the blowing housing 15, as shown in FIG. 7. The ribs 48 surround and engage the bottom section 24 of the handle legs 18 once the ends of the legs 18 are inserted through the slots 38 in the base 30 of the motor housing 12 to further secure the handle to the housing. The addition of the ribs 48 may be necessary to properly secure the handle 14 to the motor housing 12 if the handle 14 is manufactured from a less rigid plastic material.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which are within the scope of the appended claims, is reserved.

It is claimed:

1. A handle in combination with a motor housing, comprising:

a main section;

a pair of legs extending from the main section, each leg having first and second opposite sides, a fulcrum point on the first side, and first and second spaced projections on the second side, wherein the fulcrum point is disposed between the first and second projections;

first receiving means on the motor housing for engaging the first projection; and second receiving means on the motor housing for engaging the second projection, wherein applying a force to disengage either of the projections from either of the first and second receiving means reinforces the engagement of the other projection with the other receiving means.

2. The handle of claim 1, wherein the first receiving means comprises a pair of slots on a base of the motor housing and a tab located below each slot on the inside of the motor housing.

3. The handle of claim 2, wherein the first projection comprises a horizontal lip on one end of each leg.

4. The handle of claim 3, wherein the end of each leg with the lip passes through the corresponding slot on the base of the motor housing and the lip engages the tab on the inside of the motor housing.

5. The handle of claim 4, wherein the fulcrum point contacts a bearing surface on the inside of the slot.

6. The handle of claim 5, wherein the second receiving means comprises a vent opening on the side of the motor housing.

7. The handle of claim 6, wherein the second projection comprises a vertical fin extending inwardly from the middle of each leg.

8. The handle of claim 7, wherein the fin engages walls defining the vent opening on the side of the motor housing.

9. The handle of claim 8, wherein the motor housing is connected to a blower housing and a rib on the inside of the blower housing engages the bottom section of each leg and the tab on the inside of the motor housing.

10. A handle in combination with a motor housing, comprising:

a main section;

a pair of legs extending from the main section, wherein each leg has a top section joined to the main section, a middle section and a bottom section, and a fulcrum point located between the middle section and the bottom section on an outer side of each leg;

a horizontal lip extending inwardly from the bottom section of each leg for engaging the motor housing; and a vertical fin extending inwardly from the middle section of each leg for engaging the motor housing, wherein applying a force to disengage either of the lip and the fin from the motor housing reinforces the engagement of the other with the motor housing.

11. The handle of claim 10, wherein the bottom section of each leg has a width narrower than a width of the middle section.

12. The handle of claim 11, wherein the bottom section of each leg passes through a slot on a base of the motor housing such that a shoulder of the middle section of the leg rests on the base of the motor housing.

13. The handle of claim 12, wherein the horizontal lip engages a tab located below the slot on the inside of the motor housing.

14. The handle of claim 13, wherein the fin engages walls defining a vent opening on the side of the motor housing.

15. The handle of claim 14, wherein the fin and the lip are located on opposite sides of the fulcrum point.

16. The handle of claim 15, wherein the motor housing is connected to a blower housing and a rib on an inside of the blower housing engages the bottom section of the leg and the tab on the inside of the motor housing.

* * * * *